US005465995A

United States Patent [19]

Sedlmair

[11] Patent Number: 5,465,995

[45] Date of Patent: Nov. 14, 1995

[54] PEDAL FOR SKI BRAKES

[75] Inventor: Gerhard Sedlmair, Farchant, Germany

[73] Assignee: Marker Deutschland GmbH, Germany

[21] Appl. No.: 118,569

[22] Filed: Sep. 9, 1993

[30] Foreign Application Priority Data

Sep. 9, 1992 [DE] Germany ..... 9212157 U

[51] Int. Cl.[6] ..... A63C 7/10

[52] U.S. Cl. ..... 280/605

[58] Field of Search ..... 280/604, 605, 280/633, 609, 634, 636

[56] References Cited

U.S. PATENT DOCUMENTS

| | | | |
|---|---|---|---|
| 4,108,465 | 8/1978 | Schmidt et al. | 280/605 |
| 4,123,083 | 10/1978 | Riedel | 280/605 |
| 4,268,060 | 5/1981 | Svoboda . | |
| 4,288,094 | 9/1981 | Svoboda | 280/623 |
| 5,150,912 | 9/1992 | Lucas et al. | 280/605 |
| 5,158,317 | 10/1992 | Sedlmair et al. | 280/605 |

FOREIGN PATENT DOCUMENTS

| | | | |
|---|---|---|---|
| 368701 | 11/1982 | Austria . | |
| 371345 | 6/1983 | Austria . | |
| 0366942 | 5/1990 | European Pat. Off. . | |
| 2846715 | 5/1979 | Germany | 280/605 |

*Primary Examiner*—Richard M. Camby

*Attorney, Agent, or Firm*—D. Peter Hochberg; Mark Kusner; Michael Jaffe

[57] ABSTRACT

A ski brake pedal for rotating at least one lever designed in the form of a brake spur. The pedal comprising a tread portion having a raised portion formed thereon.

10 Claims, 3 Drawing Sheets

PEDAL FOR SKI BRAKES

FIELD OF INVENTION

The present invention relates generally to a pedal for ski brakes. The invention relates, more particularly, to a ski brake pedal for rotating at least one lever designed in the form of a brake spur.

Pedals for ski brakes have been previously proposed in the prior art. For example, European Patent Publication No. 366,942 describes a ski brake with brake arms arranged on either side of the ski. The brake arms and the respectively adjoining pivot pin parts and the holding arms are respectively constituted by a substantially Z-like round wheel member. The pivot pin parts extend approximately rectangularly to the longitudinal axis of the ski and approximately coaxially to one another. On the top side of the ski, they are borne by means of a holding plate. Free ends of the holding arms are angled towards each other and function as bearings for the pedal which is able to be actuated by the ski boot. The pedal in this case constitutes one arm of a toggle lever, whose second arm is borne fixedly in relation to the ski at a distance from the pivot pin parts and whose toggle joint is formed by a pivotal and sliding bearing means. The brake arms of the ski brake are able to be pivoted out of the braking position into a position in parallelism to the ski, and are able to be pivoted inward in relation to the holding arm ends towards the longitudinal axis of the ski into a standby position. In this respect, the inward pivoting motion takes place owing to a relative movement of the pedal in relation to the holding arms. The pedal disclosed by European Patent Publication No. 366,942 has a flat tread surface as in the prior art. On actuating the pedal, the sole of the ski boot rests on the tread surface. The drawbacks of the prior art are addressed by the present invention which facilitates the operational engagement of the ski boot sole and the pedal.

SUMMARY OF INVENTION

According to the present invention, there is provided for engaging a ski brake, a pedal having a tread portion and a raised portion formed on the tread portion.

In accordance with another aspect of the present invention, there is provided a ski brake pedal as described above wherein the ratio of the distance between the lateral edge of the raised portion and the furthest extending lateral edge of the tread portion to the width of the tread portion is between approximately 0.2 and 0.3.

In accordance with yet another aspect of the invention, there is provided a ski brake pedal as described above wherein the raised portion is slanted in the longitudinal direction to form a wedge-like configuration.

In accordance with a still further aspect of the present invention, there is provided a ski brake pedal as described above wherein the lateral edges of the raised portion extend obliquely towards the lateral edges of the tread portion.

Another aspect of the invention includes the tapering of the raised portion from the respective lateral edges to a longitudinally extending apex at the longitudinal axis of the raised portion.

According to yet another aspect of the invention, the raised portion is arched between the lateral edges of the raised portion and the longitudinal axis of the raised portion.

It is an object of the present invention to facilitate the operational engagement of a ski boot and a ski brake pedal.

A further object of the invention is to achieve the previous object in an economical and efficient manner. Further objects may occur from the following description and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein:

FIG. 3' is a plan view of another embodiment of the invention.

FIG. 4' is a side view of another embodiment of the invention.

DETAILED DESCRIPTION

Figure 1:
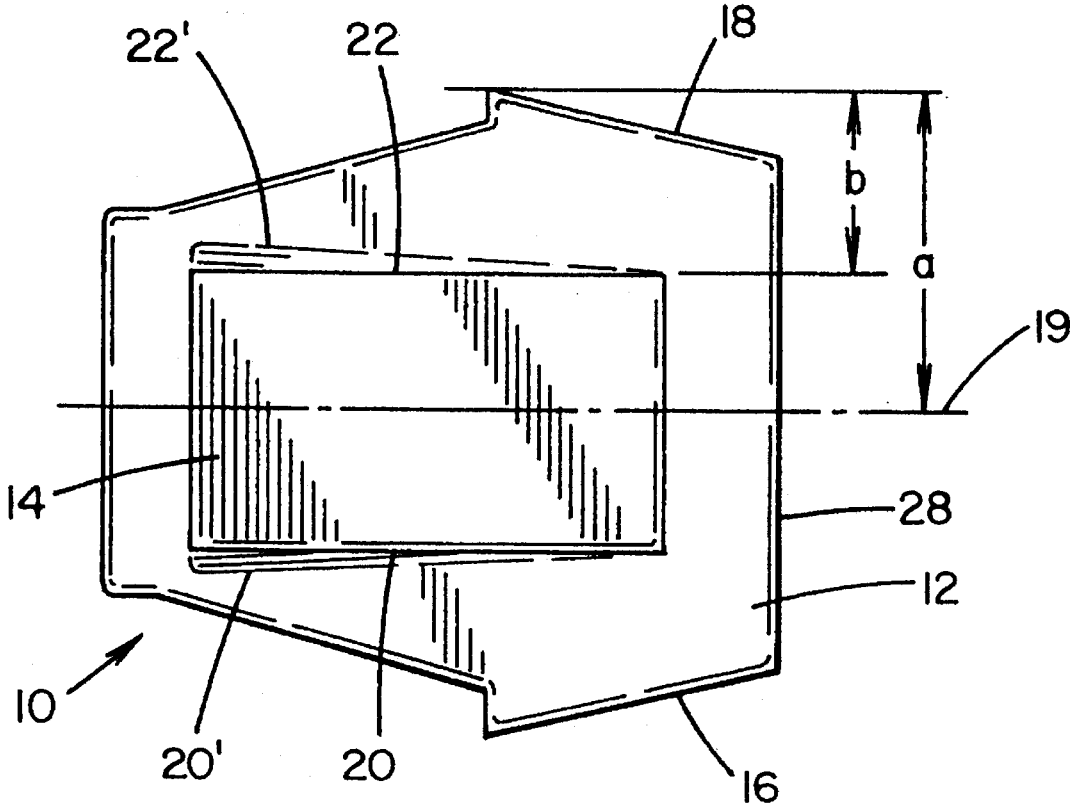
FIG. 1 is a plan view of a preferred embodiment of the present invention.

Referring now to the drawing wherein the showing is for the purpose of illustrating and the preferred embodiment of the invention only, and not for the purpose of limiting same, FIG. 1 shows a pedal 10 according to the present invention. Pedal 10 is preferably composed of a molded strong and hard plastic, and comprises a raised portion 14 formed on tread portion 12. As seen in the plan view of FIG. 1 the raised portion 14 appears in the form of a rectangular surface or area and is symmetrical with respect to lateral edges 16 and 18 of tread portion 12. Raised portion 14 is preferably integral with other plastic parts of pedal 10.

In FIG. 1 reference "a" denotes the distance of the furthest extending position of lateral edge 18, to the longitudinal axis 19 of raised portion 14 and of pedal 10, or half the overall width of pedal 10. Reference "b" denotes the distance from the furthest extending position of lateral edge 18 to the lateral edge of raised portion 14. The ratio between the distance from the furthest extending position of lateral edge 18 to the lateral edge of raised portion 14 and the total width of pedal 10 is preferably between 0.2 and 0.3. This arrangement facilitates the operational engagement of the ski boot heel and the ski boot pedal.

The lateral edges of the raised portion can be oblique to or inclined towards the lateral edges of the boot to facilitate the proper movement of pedal 10 by the boot. The inclined lateral edges are illustrated in dotted lines 20' and 22' in FIG. 1.

The general structure of the ski brake associated with pedal 10 may, for example, be in accordance with the brake disclosed in European Patent Publication 366,942A.

Figure 2:
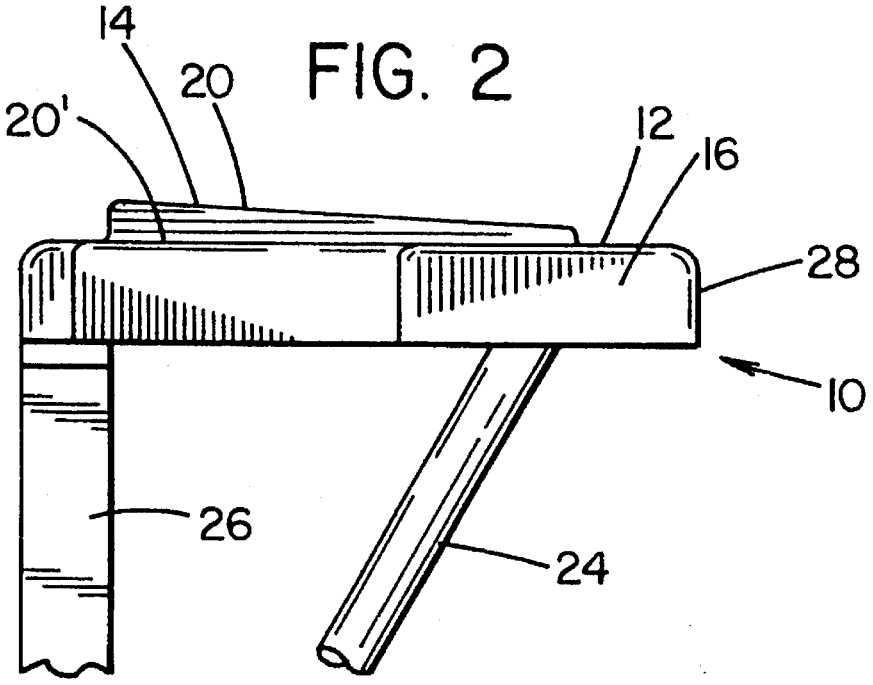
FIG. 2 is a lateral elevation of the preferred embodiment of the present invention as shown in FIG. 1.

Referring now to FIG. 2, holding arm 24 constitutes an extension of a brake spur (not shown). Pedal 10 constitutes one arm of a toggle lever, whose second arm 26 is also illustrated in FIG. 2. In the embodiment shown in FIG. 2, raised portion 14 is slanted like a wedge in the longitudinal direction. Accordingly, the height of raised portion 14 decreases from the rear towards the front edge 28 of pedal 10. Edge 28 is directed towards the front end of the ski when pedal 10 is mounted on a ski with its binding. This facilitates the operational engagement of the ski boot sole and the ski brake pedal.

Figure 3:
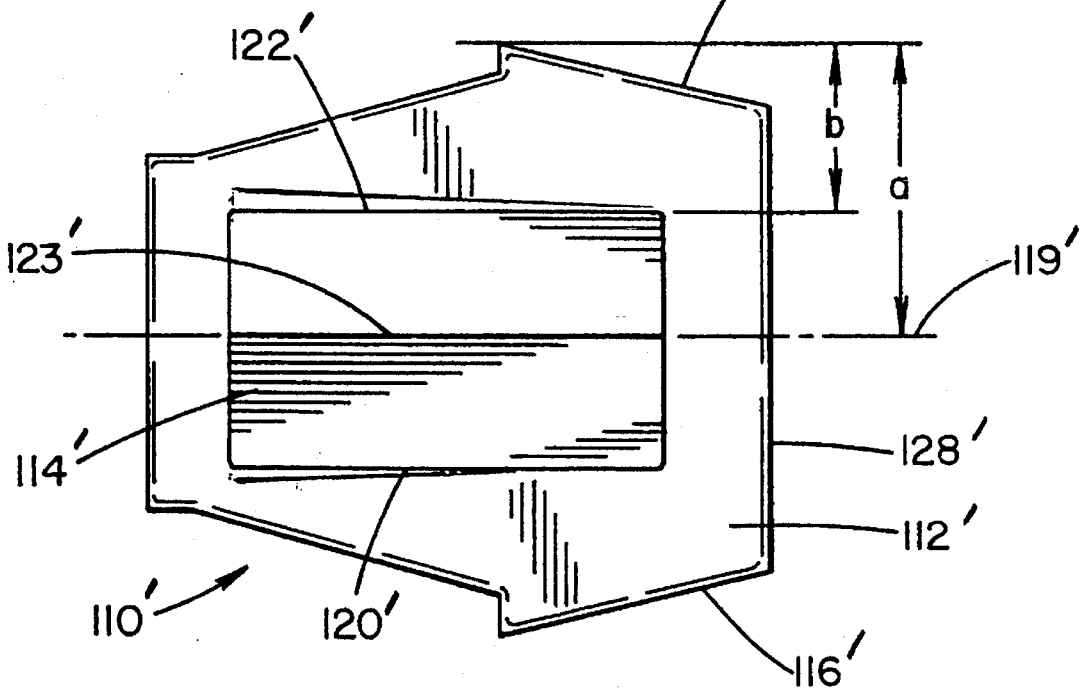
FIGS. 3–5 are plan, side and front views of another embodiment of the invention.
Figure 4:
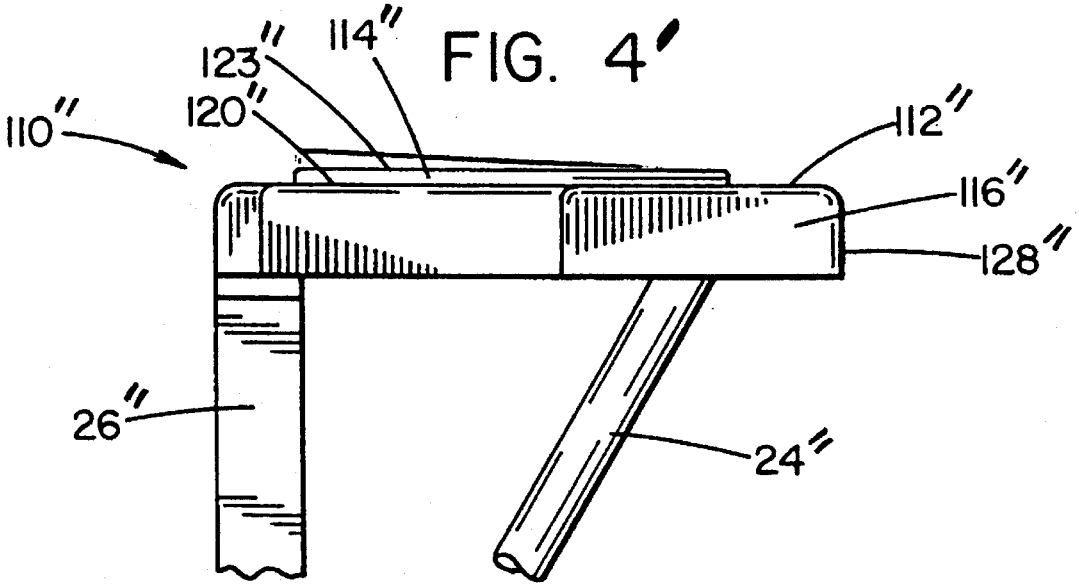
Figure 3:
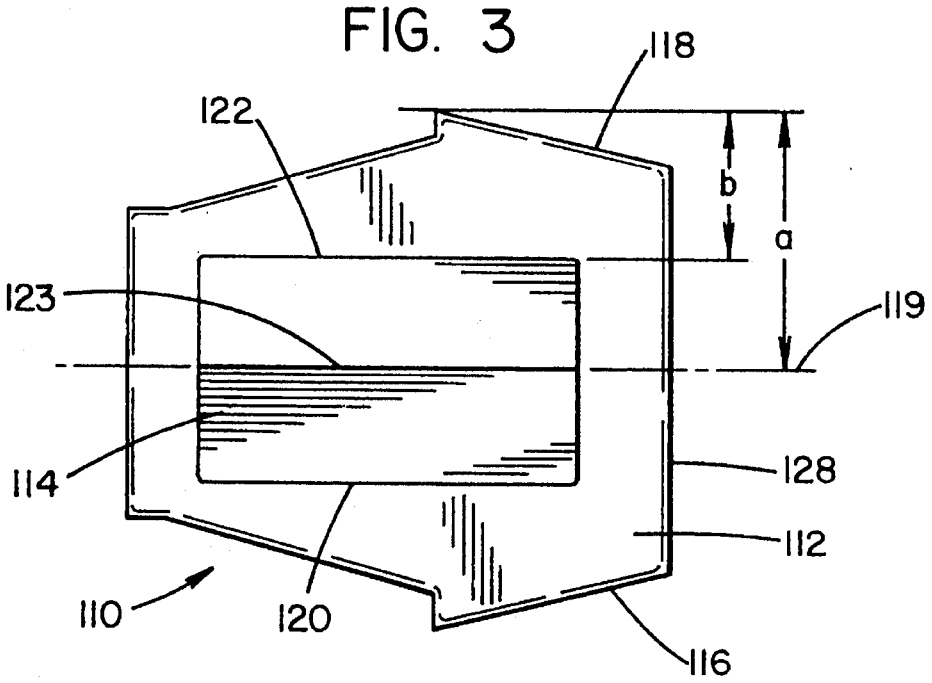
Figure 4:
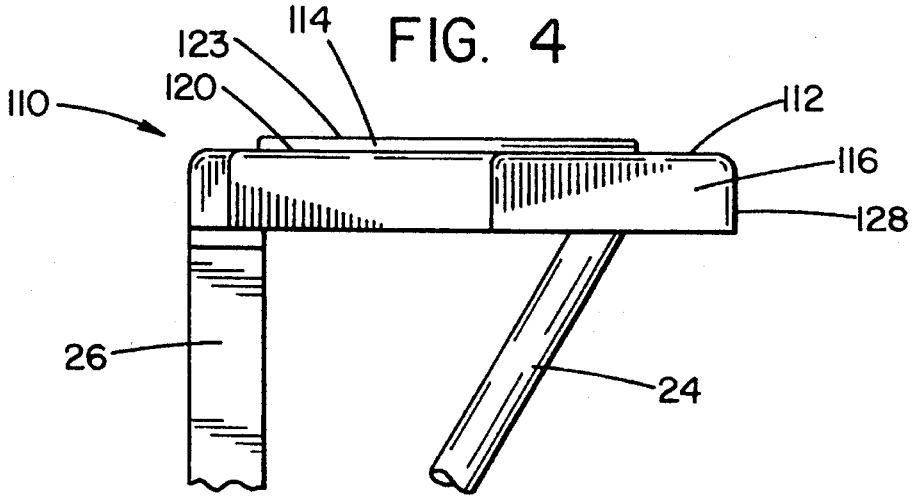
Figure 5:
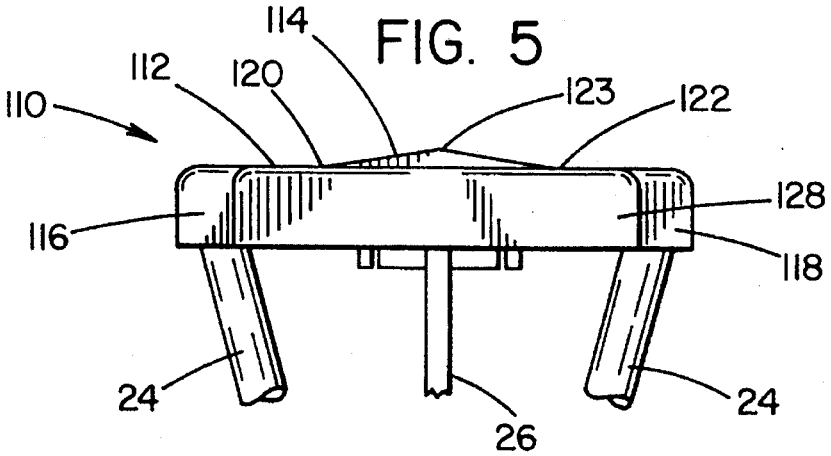

An alternative embodiment of the present invention calls for the raised portion to be arched upwards from its lateral edges towards the middle. Referring to FIGS. 3, 4 and 5, a modified pedal 110 is shown. The tread portion 112 is essentially the same as tread portion 12 of FIG. 1. Pedal 110 has a forward part 128 facing the front of a ski when the pedal is mounted on a ski with the binding of which it is a part. Pedal 110 further includes like lateral edges 116 and 118, and has a longitudinal axis 119. A raised portion 114 has lateral edges 120 and 122, which are equidistant from lateral edges 116 and 118 of pedal 110. Raised portion 110 shares longitudinal axis 119. Edges 116 and 118 are angled with respect to axis 119, and have a surface extending furthest from axis 119. The distance from the lateral edge 122 to the furthest surface of lateral edge 118 is "b," and the distance from longitudinal axis 119 to the further surface of lateral edge 118 is "a," as explained earlier with reference to FIG. 1. Also as noted, the ratio of b/2a is between 0.2 and 0.3.

Raised portion 114 is arched from its lateral edges to its middle or apex 123, as shown in FIG. 5. This is another modification in the configuration of the raised portion of the pedal to facilitate the operational engagement of the pedal by the ski boot sole. Portion 114 can be formed integrally with the tread portion 112 of the pedal.

In the alternative embodiment shown in FIG. 3', the lateral edges 120' and 122' are slanted laterally and raised portion 114' is arched to its middle or apex 123'. This arrangement In the alternative embodiment shown in FIG. 4' raised portion 114" is slanted like a wedge in the longitudinal direction. Accordingly, the height of raised portion 114" decreases from the rear towards the front edge 128" of pedal 110". Furthermore, raised portion 114" is also arched to its middle or apex 123". This arrangement facilitates the operational engagement of a ski boot and ski brake pedal.

The invention has been described in detail with particular emphasis having been placed on the preferred embodiments thereof, but variations and modifications within the spirit and scope of the invention may occur to those skilled in the art to which the invention pertains.

Thus, having described the invention, the following is claimed:

1. A pedal for operating a ski brake for a ski, the ski brake having at least one movable lever in the form of a brake spur, said pedal comprising:

a tread portion having a longitudinal axis and bounded by lateral edges; and an inclined raised portion integrated with said tread portion, said inclined raised portion comprised of at least one inclined plane having generally longitudinally extending lateral edges, for facilitating the operational engagement of a ski boot heel and said pedal, wherein the ratio of the distance between the generally longitudinally extending lateral edge of said raised portion and the furthest extending position along the generally longitudinally extending lateral edge of said tread portion, to the maximum width of said tread portion located perpendicularly to the longitudinal axis of said tread portion is between approximately 0.2 and 0.3.

2. A pedal according to claim 1, wherein said raised portion is generally rectangular, and said raised portion and said tread portion are longitudinally coaxial.

3. A pedal according to claim 1, wherein said raised portion is slanted in the longitudinal direction to form a wedge.

4. A pedal according to claim 1 said pedal having a rear part for facing the back part of the ski and a front part for facing the front part of the ski, when the pedal is mounted on the ski, wherein said at least one inclined plane slants downwardly from the back part of the ski towards the front part of the pedal, when the pedal is mounted on the ski.

5. A pedal for operating a ski brake for a ski, the brake having at least one movable lever in the form of a brake spur, said pedal comprising:

a tread portion having a longitudinal axis and bounded by lateral edges; and a generally longitudinally extending raised portion having lateral edges and being integrated with said tread portion, wherein said raised portion is inclined from the middle of the raised portion towards the longitudinally extending lateral edges of said raised portion, said raised portion and said ski being longitudinally coaxial, wherein the ratio of the distance between a longitudinally extending lateral edge of said raised portion and a furthest extending position along the generally longitudinally extending lateral edge of the tread portion, to the maximum width of the tread portion is between approximately 0.2 and 0.3.

6. A pedal according to claim 5, wherein said raised portion is inclined in the longitudinal direction of the ski.

7. A pedal for operating a ski brake for a ski, the brake having at least one movable lever in the form of a brake spur, said pedal comprising:

a tread portion having a longitudinal axis and bounded by lateral edges; and a generally longitudinally extending raised portion having lateral edges and being integrated with said tread portion, said raised portion comprised of a pair of planar inclined surfaces, wherein the ratio of the distance between a longitudinally extending lateral edge of said raised portion and a furthest extending position along the generally longitudinally extending lateral edge of the tread portion, to the maximum width of the tread portion is between approximately 0.2 and 0.3.

8. A pedal according to claim 7, wherein each of said planar inclined surface extends from the longitudinal axis of said raised portion to the longitudinally extending lateral edges of said raised portion.

9. A pedal according to claim 8, wherein said raised portion is inclined in the longitudinal direction of the ski.

10. A pedal for operating a ski brake for a ski, the brake having at least one movable lever in the form of a brake spur, said pedal comprising:

a tread portion having a longitudinal axis and bounded by lateral edges, a raised portion integrated with said tread portion, said raised portion having a longitudinal axis extending in the longitudinal direction of the ski and having generally longitudinally extending lateral edges, wherein the ratio of the distance between the generally longitudinally extending lateral edge of said raised portion and the furthest extending position along the generally longitudinally extending lateral edge of said tread portion, to the maximum width of said tread portion located perpendicularly to the longitudinal axis of said tread portion, is between approximately 0.2 and 0.3.

* * * * *